United States Patent [19]

Imazeki et al.

[11] 4,323,839

[45] Apr. 6, 1982

[54] CONSTANT CURRENT LOAD AND CONSTANT VOLTAGE LOAD POWER SUPPLY

[76] Inventors: Kazuyoshi Imazeki; Shozo Iguchi, both of 6-2-15 Roppongi, Minato-ku, Tokyo, Japan

[21] Appl. No.: 219,335

[22] Filed: Dec. 22, 1980

[51] Int. Cl.[3] ..... G05F 1/56

[52] U.S. Cl. ..... 323/267; 307/34; 358/217

[58] Field of Search ..... 307/30, 33, 34, 297; 323/267, 273, 281, 311, 312; 358/190, 217, 219

[56] References Cited

U.S. PATENT DOCUMENTS 3,544,816 12/1970 Ogawa et al. ..... 307/297 X

FOREIGN PATENT DOCUMENTS 47-21510 6/1972 Japan ..... 323/273

52-76661 6/1977 Japan ..... 323/273

*Primary Examiner*—A. D. Pellinen

*Attorney, Agent, or Firm*—Trexler, Bushnell & Wolters, Ltd.

[57] ABSTRACT

A regulating transistor is connected between a constant current load and a constant voltage load. A control circuit responds to voltage variations of the constant voltage load to adjust the transistor whereby a constant current and a constant voltage and supplied to both loads. In a vidicon camera circuit a focusing coil presents a constant current load and a heater element presents a constant voltage load.

5 Claims, 5 Drawing Figures

PRIOR ART
10
12
14
LOAD
16
18
20
22
CONTROL CIRCUIT 24
12
20
22
26
28
LOAD
CONTROL CIRCUIT 24
12
20
22
30
CONTROL CIRCUIT 12
32
FOCUSING COIL
36
38
40
42
44
46
34
HEATER 12
48
36
50
52
54
POWER SUPPLY OF FIG. 4

CONSTANT CURRENT LOAD AND CONSTANT VOLTAGE LOAD POWER SUPPLY

BACKGROUND OF THE INVENTION

This invention relates to a constant-current power supply and more particularly to an improvement in a constant current power supply to also serve as a constant voltage power supply.

A conventional three-terminal type constant voltage power supply is conventionally constructed utilizing voltage-dividing resistors across the load for negative feedback to a control circuit. This control circuit detects the amount of change in the output voltage due to a variation in the load and, in response thereto, controls an output transistor to maintain the output voltage constant.

A conventional three-terminal type constant current power supply is substantially similar to the above-described constant voltage power supply. However, a current-detecting element such as a resistor is used in series with the load for detection of the output current. The control circuit is responsive to the voltage developed across this resistor, for controlling the output transistor so as to insure a constant output current at all times, usually by comparing the voltage drop of this current-detecting resistor with a predetermined reference voltage.

A constant current power supply may also be constructed so that the control circuit controls an input, that is, a load current, to the output transistor so as to maintain a constant current output in response to a voltage level obtained from a current-detecting variable resistor at the power supply output.

In accordance with conventional practice, a constant voltage power supply and a constant current power supply of the type described must be separately provided in order to feed both a constant-current load and a constant-voltage load, and this has proven both expensive and inconvenient.

OBJECTS AND SUMMARY OF THE INVENTION

It is therefore an object of this invention, to provide a single power supply which will feed a constant-voltage load and a constant-current load at the same time.

Briefly, and in accordance with the foregoing object, the invention provides a constant current, constant voltage power supply comprising current adjusting means and control circuit means for controlling said current adjusting means to feed a constant current to a load connected to an input side of said current adjusting means and a constant voltage to a load connected to the output side of said current adjusting means, respectively, said control circuit means being further responsive to a variation in said constant voltage load for controlling said current adjusting means to supply a constant current and a constant voltage to said two loads, respectively, at the same time.

BRIEF DESCRIPTION OF THE DRAWINGS

The foregoing as well as other objects, features, and advantages of the invention will be more readily appreciated upon reading the following detailed description of the illustrated embodiment, together with reference to the accompanying drawings, wherein.

DETAILED DESCRIPTION OF THE ILLUSTRATED EMBODIMENT

Figures 1, 2, 3, 4, 5:
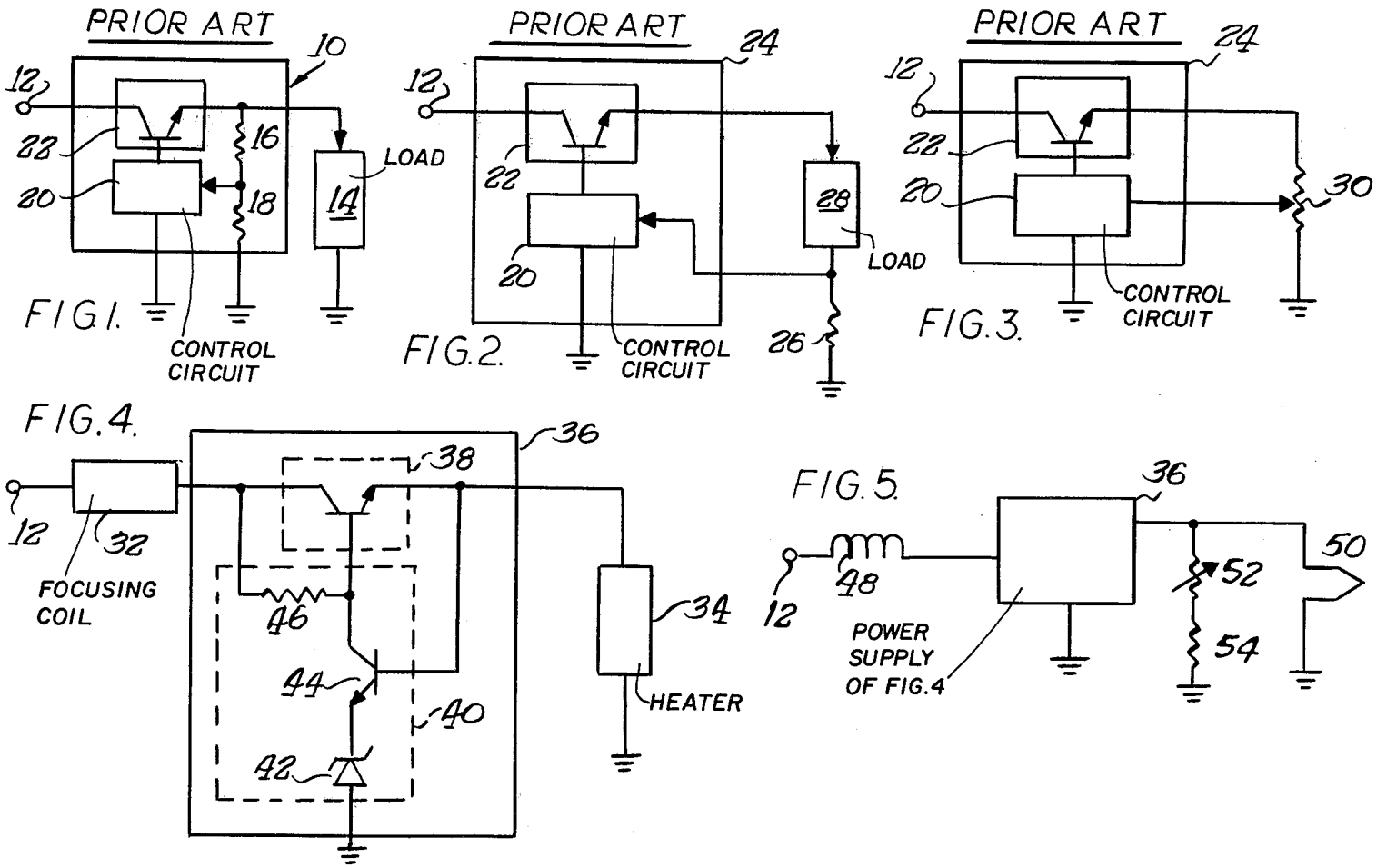
FIG. 1. PRIOR ART
FIG. 2. PRIOR ART
FIG. 1 is a block diagram showing a conventional constant voltage power supply.
FIG. 2 and FIG. 3 are block diagrams each showing a conventional constant current power supply.
FIG. 4 is a circuit diagram showing one embodiment of the invention.
FIG. 5 shows an embodiment of this invention applied to a vidicon camera circuit.

A conventional three-terminal type constant voltage power supply is constructed, for example, as shown in FIG. 1. A constant voltage power supply circuit 10 has an input terminal 12 and a load 14 respectively. The constant voltage power circuit 10, as is well known, includes voltage-dividing resistors 16 and 18 across the output or load 14 for negative feedback, a control circuit 20 and an adjusting transistor 22. The control circuit 20 detects the amount of change in the divider voltage due to a variation in the load 14 and, in response thereto, controls the transistor 22 to maintain the output voltage constant.

FIG. 2 shows a conventional three-terminal type constant current power supply 24. The constant current power circuit 24 is substantially the same as in the above-described constant voltage power supply 10. However, a current-detecting resistor 26 is used in series with a load 28 for detection of the output current. The control circuit 20 controls the transistor 22 so as to insure a constant output current at all times by comparing the voltage drop across the resistor 26 with a predetermined reference voltage.

The constant current power supply 24 may also be constructed as shown in FIG. 3. That is to say, the control circuit 20 controls an input, that is, a load current, to the transistor 22 so as to hold the output current constant, in response to an output from a current-detecting variable resistor 30 at the output.

Departing from convention, in FIG. 4, a constant current load 32 and a constant voltage load 34 are supplied from a single power supply 36, constructed according to the invention. The constant current load 32 is connected to the input (collector) of an adjusting transistor 38 and the constant voltage load 34 is connected to the output (emitter) of the adjusting transistor 38 and to a control circuit 40.

In accordance with the invention, the control circuit 40 comprises a reference voltage-generating Zender diode 42 and an error voltage-amplifying transistor 44 and a negative feedback resistor 46 between the respective collectors of the transistors 38 and 44. In response to the voltage drop of the constant voltage load 34 (current being constant) the circuit 40 controls the transistor 38 to adjust the output voltage thereof to the load 34 to the required constant voltage.

Accordingly, the current which flows to the load 34 becomes constant, and therefore the input current to the transistor 38, that is, the current which flows to the load 32, also becomes constant. Thus, the constant current load 32 and the constant voltage load 34 can be fed at the same time.

Briefly, the Zener diode 42 establishes a constant or reference voltage point above ground at the emitter of the transistor 44. Hence, a change in the base potential due to changes in the power requirements of the load 34 results in a corresponding change in collector current of the transistor 44, which corresponds to the base current of the transistor 38. Therefore, a corresponding but inversely related change occurs in the collector-emitter current of the transistor 38 which is supplied from the load 32. However, provision of the feedback resistor 46 between the collector of the transistor 38 and the collector of transistor 44 (which is tied to the base of the transistor 38) permits such changes in the collector-emitter current of the transistor 38 without disturbing the constant current flow to the load 32.

FIG. 5 shows an embodiment of this invention applied to a vidicon camera circuit. In FIG. 5, a coil 48 represents a focusing coil of a vidicon camera which presents a constant current load. A heater element 50 of the vidicon camera presents a constant voltage load. A variable resistor 52 and fixed resistor 54 connected across the heater 50 comprise a focusing current adjusting circuit. The power supply 36 is the same as that shown in FIG. 4.

In operation, if, for example, a non-regulated voltage of +22 V is applied to the input terminal 12, then, a constant current of 125 mA, for example, to the focusing coil 48 and a constant voltage of 6 V (95 mA), for example, to the heater 50 can be supplied, respectively, at the same time.

What has been illustrated and described herein is a novel power supply capable of feeding a constant current load and a constant voltage load at the same time, so that the effect in practical use is striking.

While preferred embodiments have been illustrated and described herein, the invention is not limited thereto. On the contrary, various alternatives, modifications and changes may occur to those skilled in the art, and the present invention is intended to include such alternatives, modifications and changes insofar as they fall within the spirit and scope of the appended claims.

The invention is claimed as follows:

1. A constant current, constant voltage power supply comprising current adjusting means and control circuit means for controlling said current adjusting means to feed a constant current to a load connected to an input side of said current adjusting means and a constant voltage to a load connected to the output side of said current adjusting means, respectively, said control circuit means being further responsive to a variation in said constant voltage load for controlling said current adjusting means to supply a constant current and a constant voltage to said two loads, respectively, at the same time.

2. A constant current, constant voltage power supply according to claim 1 wherein said current adjusting means comprises a transistor having a collector emitter current path in circuit between said constant current load and said constant voltage load and a control terminal, said control circuit means being coupled with said control terminal.

3. A constant current, constant voltage power supply according to claim 1 or claim 2 wherein said control circuit means comprises a bipolar transistor having a collector-emitter path coupled between said current adjusting means and ground, a control terminal coupled to said constant voltage load, and a reference voltage source coupled between said collector-emitter path and ground.

4. A constant current, constant voltage power supply according to claim 3 wherein said control circuit means further includes a negative feedback resistor coupled between said collector-emitter current path and said constant current load.

5. A constant current, constant voltage power supply according to claim 4 wherein said reference voltage source comprises a zener diode.

* * * * *